US007364065B2

(12) United States Patent
Willemsen

(10) Patent No.: US 7,364,065 B2
(45) Date of Patent: Apr. 29, 2008

(54) FLEXIBLE CLOSURE FOR A CONTAINER

(75) Inventor: Louis Rinze Henricus Adrianus Willemsen, Labuan (MY)

(73) Assignee: Weasy Pack International Ltd., Labuan (MY)

( * ) Notice: Subject to any disclaimer, the term of this patent is extended or adjusted under 35 U.S.C. 154(b) by 524 days.

(21) Appl. No.: 10/398,241

(22) PCT Filed: Oct. 3, 2001

(86) PCT No.: PCT/NL01/00730

§ 371 (c)(1),
(2), (4) Date: Sep. 22, 2003

(87) PCT Pub. No.: WO02/32772

PCT Pub. Date: Apr. 25, 2002

(65) Prior Publication Data

US 2004/0045989 A1 Mar. 11, 2004

(30) Foreign Application Priority Data

Oct. 3, 2000 (NL) ..... 1016312

(51) Int. Cl.
*B65D 43/20* (2006.01)

(52) U.S. Cl. ..... 229/123.1; 220/345.1; 220/350; 229/125.04; 229/125.12; 229/125.125; 229/125.15

(58) Field of Classification Search ..... 229/125.04, 229/125.12, 125.125, 125.15, 123.1; 220/345.1, 220/350, 351; 222/527, 528, 530, 531, 537, 222/559, 561, 566, 572
See application file for complete search history.

(56) References Cited

U.S. PATENT DOCUMENTS 2,154,584 A * 4/1939 Rossi ..... 222/527
3,093,274 A * 6/1963 Galbierz ..... 222/566
4,216,880 A 8/1980 Drelichowski
4,452,382 A * 6/1984 Von Holdt ..... 222/529
4,767,035 A * 8/1988 Jacobi ..... 222/527
4,917,267 A * 4/1990 Laverdure ..... 222/541.5

(Continued)

FOREIGN PATENT DOCUMENTS

DE 33 27 728 2/1985

(Continued)

OTHER PUBLICATIONS

Patent Abstracts of Japan, vol. 1998, No. 01, Jan. 30, 1998, & JP 09 240736 A (Hagiwara Tadashi), Sep. 16, 1997, abstract; figure 1.

(Continued)

*Primary Examiner*—Gary E Elkins
(74) *Attorney, Agent, or Firm*—Young & Thompson

(57) ABSTRACT

A container for a fluid, comprising a pouring element comprises a pouring spout manufactured from a flexible material which is connected by a sealing connection (5) to the container. A pouring spout manufactured from flexible material, for instance plastic foil or a plastic laminate foil with for instance aluminum, is much less expensive than the containers heretofore provided with a pouring spout. According to a preferred embodiment the pouring element is provided with a once-only breakable closure (10) and with a resealable closure (7, 21).

10 Claims, 4 Drawing Sheets

U.S. PATENT DOCUMENTS

| | | | | | |
|---|---|---|---|---|---|
| 4,986,465 | A | * | 1/1991 | Jacobsson et al. | 220/269 |
| 5,002,222 | A | * | 3/1991 | Giblin | 229/123.1 |
| 5,065,914 | A | * | 11/1991 | Chollet | 222/531 |
| 5,240,112 | A | | 8/1993 | Newburger | |
| 5,364,019 | A | * | 11/1994 | Bjorck et al. | 229/125.15 |
| 5,875,958 | A | * | 3/1999 | Weiteder et al. | 229/125.15 |
| 6,161,728 | A | * | 12/2000 | Dark | 222/530 |

FOREIGN PATENT DOCUMENTS

| | | | | |
|---|---|---|---|---|
| EP | 367092 | A1 * | 5/1990 | 229/123.1 |
| GB | 2 202 213 | | 9/1988 | |
| JP | 58-134852 | | 8/1983 | |
| JP | 63-248663 | | 10/1988 | |
| JP | 09-240736 | | 9/1997 | |
| JP | 10-007132 | | 1/1998 | |
| JP | 11-236074 | | 8/1999 | |

OTHER PUBLICATIONS

Patent Abstracts of Japan, vo. 1998, No. 05, Apr. 30, 1998, & JP 10 007132 A (Dainippon Printing Co Td), Jan. 13, 1998, abstract.

* cited by examiner

FLEXIBLE CLOSURE FOR A CONTAINER

The invention relates to a container for fluids, comprising a pouring opening and a pouring element connecting onto the pouring opening.

Such a container is known as a block-pack for milk, fruit juice and so on.

At the moment these containers are usually provided with instructions for cutting off a folded point of this container, so that pouring is possible.

The invention is applicable not only to the above mentioned block-packs but also to packs manufactured from similar material which are provided on their top with sloping top surfaces.

The invention is further applicable in the case of containers in the form of a sachet, such as are used for small packages for mayonnaise, but which are also used in a larger form for packaging liquid detergent as refill pack, or as container for lemonade which is placed in the freezer to produce an ice lolly. The invention can further be used for a plastic bottle, such as is known in Britain for packaging milk or, for instance, motor oil.

All these packagings have an opening which is difficult to operate and difficult to open, is not completely hygienic, not resealable or which results in spillage.

The opening of a block-pack thus requires the use of scissors or a knife, while the use of a tear seam does not usually prevent spillage. Such a closure is furthermore not resealable.

Such packs are further known which are provided with a plastic insert. This plastic insert is provided with a flap with which the pouring opening can be closed. This does enable resealing of the container. Such a plastic insert is expensive, both in manufacture and placing.

In addition, separate measures are necessary to make clear to the purchaser that the packaging is intact. It is thus known to arrange a sealing tab over the pouring opening, while it is also possible to arrange a plate which must be pressed into the pack with the fingers. This is however not very hygienic since it requires insertion of the fingers into the pack.

The object of the invention is to provide such a container wherein the above stated problems are obviated.

This object is achieved in that the pouring element comprises a pouring spout manufactured from a flexible material which is connected by means of a sealing connection to the container.

A spout manufactured from flexible material, for instance plastic foil or a plastic laminate foil with is for instance aluminium, is much less expensive than the containers heretofore provided with a pouring spout. This material moreover provides the option of arranging this material on a pack by means of a sealing seam. Such a spout can further be closed by for instance a tear-off or cut-off sealing seam. This does of course require the use of scissors or knife for opening, but spillage can be prevented more easily during the opening operation.

According to a preferred embodiment the pouring element is provided with both a once-only breakable closure and with a resealable closure.

So as to make the resealable opening easily accessible, it is attractive if the resealable closure is arranged on the distal end of the pouring spout.

Such a closure can for instance be formed when the resealable closure comprises mutually engaging profiles arranged on the inside of the pouring spout and placed opposite each other.

Such a closure also finds application for instance as closure for plastic bags. Another embodiment teaches that the breakable closure can be formed by adhesive strips arranged on the inside of the spout, placed opposite each other and repelling the content of the container.

A closure can further be formed by applying two stiff or rigid strips which normally keep the spout closed and which can be opened by means of a force applied in longitudinal direction. Fruitful use can also be made of an "over-the-centre" mechanism.

Yet another embodiment teaches that the resealable closure is adapted to be effective when the pouring spout is folded. The fold herein provides a closure. This closure can be used as additional closure in combination with other closures.

Folding is facilitated and the closure improved when the pouring spout is provided with strengthening which is provided with a thinned portion extending in the fold direction.

It is attractive when the pouring spout or the upper layer of the pack is provided with an adhesive layer for holding the spout fixedly on the top side of the pack in the folded state.

Less space is hereby taken up by the pouring spout on the one hand and preserving of the sealed state is enhanced on the other.

Use can also be made of a closure which presses both edges of the pouring spout against the wall of the container. Use can also be made here of rigid profiles.

In many embodiments of block-packs it is usual for a breakable closure to comprise a sealing foil arranged against the inner side of the opening. In the present invention this results in problems because the spout makes the sealing foil inaccessible.

An attractive embodiment therefore provides the measure that the sealing foil is fixedly connected to a pull element extending through the pouring spout to a position outside the spout, and that the connection between the pull element and the sealing foil is stronger than the connection between the sealing foil and the inner side of the container.

It hereby becomes possible to remove the sealing foil from outside.

According to a particularly attractive embodiment the pull element is connected to the side of the sealing foil opposite to the pulling direction.

When the pull element is pulled only a small force then has to be absorbed, because the sealing foil is as it were unrolled.

An embodiment which is particularly cost-saving in respect of production is obtained when the pouring spout is manufactured from the same material as the pull element, and the combination of pouring spout and pull element is manufactured by folding a piece of material of the appropriate dimensions into an S-shape.

The problems of placing the pull element in a pouring spout are hereby avoided.

Production is simplified even further when the pull element is connected to the spout by weakened bridges, and the elements of the pouring spout lying above one another are mutually connected by sealing. This measure provides the option of manufacturing the pouring spout integrally with the pull element beforehand and then arranging it on the, container. Only the connections to the spout have to be broken.

The measure that the sealing foil is formed integrally with the pull element also greatly simplifies production; the sealing foil, the spout and the pull element can be arranged on the container in one operation.

A further simplification results when the pouring spout is provided with a fold, of which a part extending in the interior of the spout is connected to the sealing foil, and a part of the fold extending outside the spout can be grasped to pull loose the sealing foil while preserving the integrity of the pouring spout.

A separate pull element is no longer necessary here.

The present invention will be elucidated hereinbelow with reference to the annexed drawings, in which.

Figure 1:
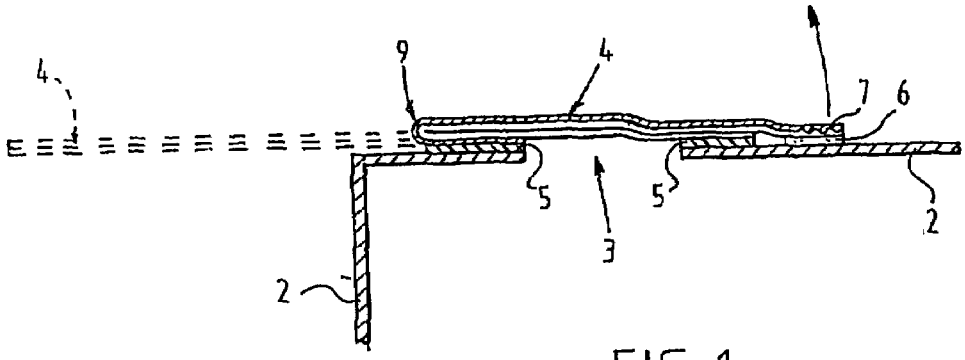
FIG. 1 shows a partial cross-sectional view of a first embodiment of the present invention.
Figure 2:
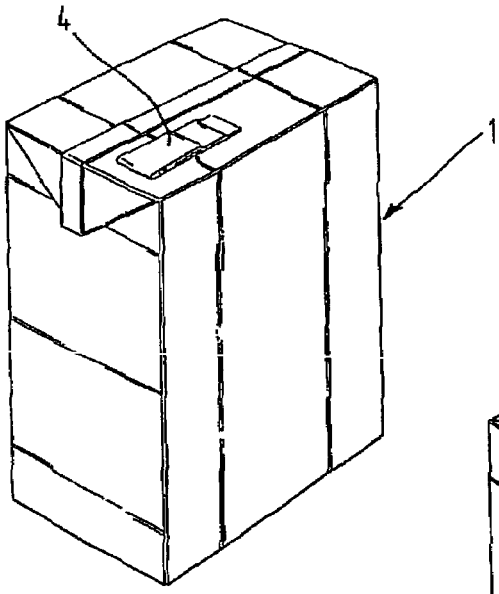
FIG. 2 is a perspective schematic view of the embodiment shown in FIG. 1 in the closed position.
Figure 3:
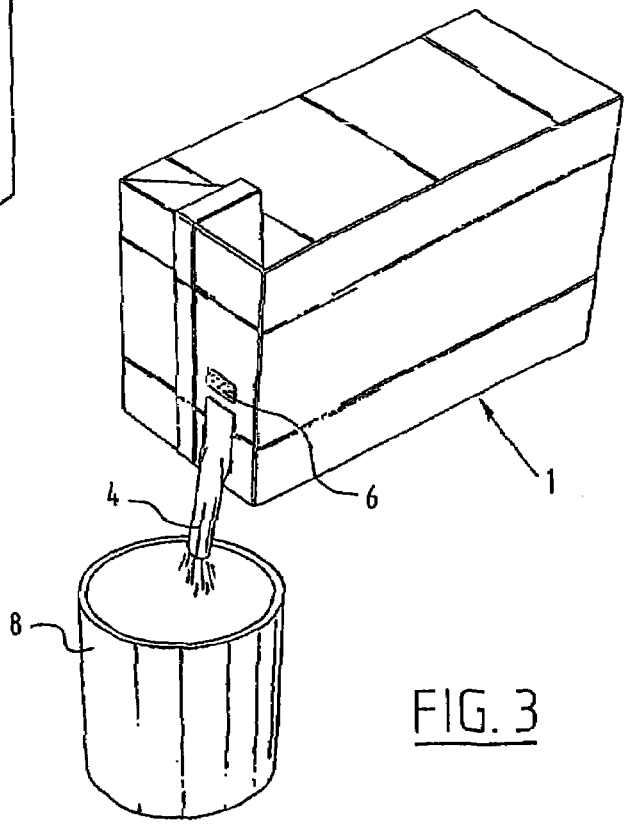
FIG. 3 is a perspective view of the embodiment shown in FIGS. 1 and 2 during pouring.

FIGS. 1, 2 and 3 show a so-called block-pack 1 manufactured from cardboard laminate and generally known for packaging juice, milk and other drinks. The block-pack is manufactured from cardboard laminate 2. An opening 3 is arranged in the cardboard laminate at the position of the arranged pouring spout. The opening is sealed by a pouring spout designated as a whole with 4. Pouring spout 4 is manufactured from flexible material, thus for instance a flexible plastic, although it is also possible to make use for this purpose of another flexible material, for instance appropriately impregnated paper or a laminate of paper, plastic, metal foil and so on. Pouring spout 4 is connected to the cardboard laminate by means of a sealing adhesive layer 5. In FIG. 1 the container is shown in its closed position. Pouring spout 4 is herein folded up in wholly flat form, which is also shown in FIG. 2. In order to hold the spout securely in this position, it is provided on its distal end with an adhesive layer 6. This latter ensures that the distal end of the spout remains against the top side of cardboard laminate 2. Adhesive layer 6 is however chosen such that the pouring spout can be released more readily. In order to make a releasable closure the spout is provided on its distal end with a toothing 7 on the inner side. This toothing ensures that the spout, and thereby the container, are kept closed. Such a toothing is known per se, for instance in the field of plastic bags. Other methods of sealing may also be obtained instead, for instance with an internal adhesive layer. This adhesive layer must of course be chosen so that flow of the content does not adversely affect the quality of the adhesive layer.

Adhesive layer 6 can however also be arranged on the top side of pack 1, as shown in FIG. 3. FIG. 3 also shows that when pouring spout 4 is folded open it is suitable for pouring into for instance a glass B. It will be apparent that other closing mechanisms can also be provided; it is thus possible for instance for a sealing action to be obtained at the position of fold 9 by a suitable choice of material. The material will herein be chosen so, as to be slightly thicker in the vicinity of the fold and slightly thinner at the position of the fold, so that the fold will be created at the precisely defined position.

In the previously mentioned embodiment a resealable closure is provided; in the present case the resealable closure must also serve as permanent closure prior to first opening of the pack by the consumer.

Figure 4:
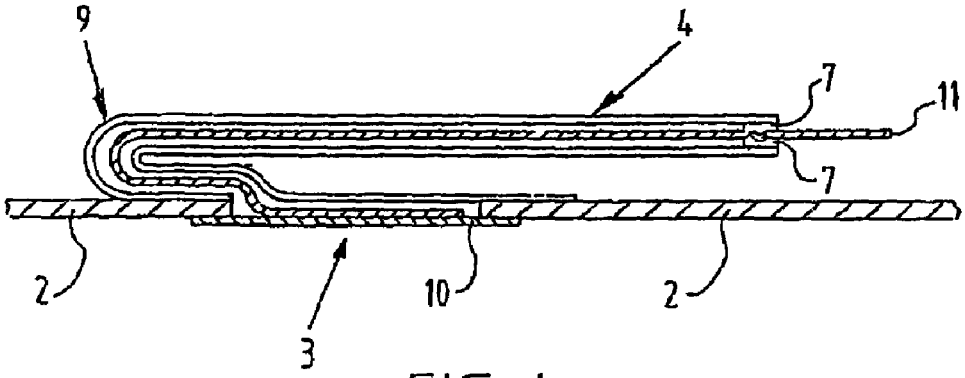
FIG. 4 shows a cross-sectional view of a second embodiment of the present invention.

FIG. 4 shows an embodiment which is provided with a breakable-only closure which is broken only when the pack is first opened by the consumer. A sealing foil is here arranged on the underside of opening 3 in the cardboard laminate 2. This foil can form part of the actual cardboard laminate itself, or can be a foil arranged specifically for this purpose which is arranged against the inside or outside of the cardboard laminate. On the top of this sealing foil is arranged a flexible pull element 11 which extends through the interior of pouring spout 4 to a position outside spout 4. Here also the pouring spout 4 is connected by suitable connecting means to the outer side of cardboard laminate 2. When the consumer wishes to open a container provided with such a spout, he/she has only to pull on the protruding end of pull element 11. When pull element 11 is pulled the sealing foil 10 will release and can be pulled outward together with the pull element. It is of course important for this purpose that the adhesion between sealing foil 10 and pull element 11 is firmer than the adhesion between sealing foil 10 and cardboard laminate 2. The invention is improved when pull element 11 is connected to the side of sealing foil 10 shown on the right in FIG. 4. Pulling is hereby facilitated; the sealing foil is as it were peeled off.

Figure 5A:
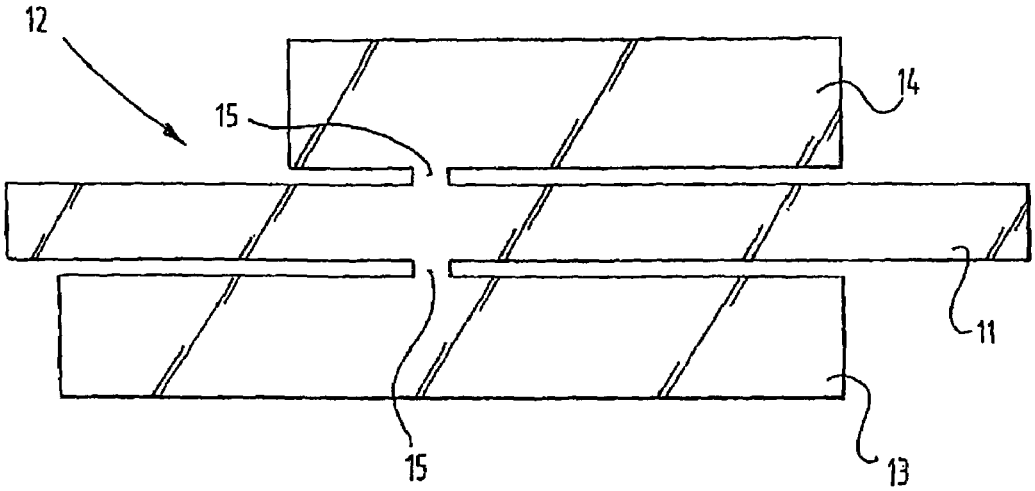
FIG. 5A shows a top view of a blank for manufacturing a third embodiment of the present invention.
Figure 5B:
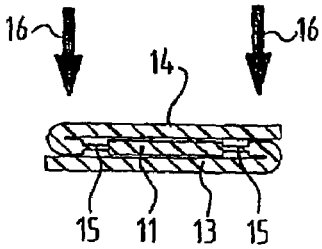
FIG. 5B is a cross-sectional view of the blank shown in FIG. 5A after it is folded together.
Figure 5C:
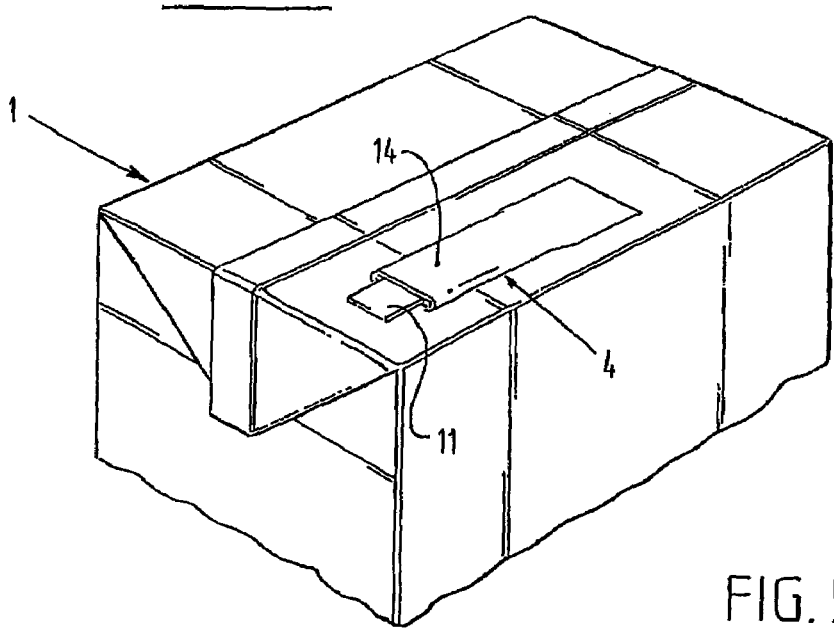
FIG. 5C is a perspective detail view of the embodiment shown in FIGS. 5A and 5B.

In order to produce such a combination of pouring spout 4 and pull element 11 use can be made of the blank 12 shown in FIG. 5A. The blank is formed by pull element 11 and two parts 13 and 14 of spout 4, each connected to pull element 11 by means of a material bridge 15. When this blank is folded into an S-shape a structure is created with the cross-section as shown in FIG. 5B. By carrying out a sealing treatment at the position of arrows 16 the structure is obtained which can be arranged integrally on the top of a block-pack 2. Such a structure is shown in FIG. 5 in the arranged situation. As in the foregoing embodiment, the pouring spout can herein be provided with a toothing or and adhesive layer in order to still arrange a breakable closure after breaking of the sealing foil.

Figure 6:
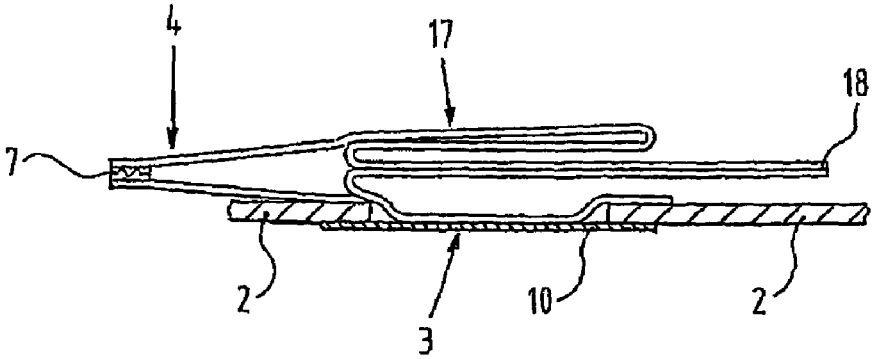
FIG. 6 shows a cross-sectional view of a fourth embodiment of the present invention.

FIG. 6 shows another embodiment wherein the pull element is integrated into the pouring spout. For this purpose a double fold 17 is arranged in pouring spout 4. As a result of this double fold 17 a part 18 of spout 4 protrudes on the part opposite the distal end of spout 4. Such an embodiment is shown in FIG. 6. When the part 18 of the spout is pulled, the sealing foil 10 will be pulled loose, whereafter it will be possible to pour using the distal end of the spout.

Figure 7:
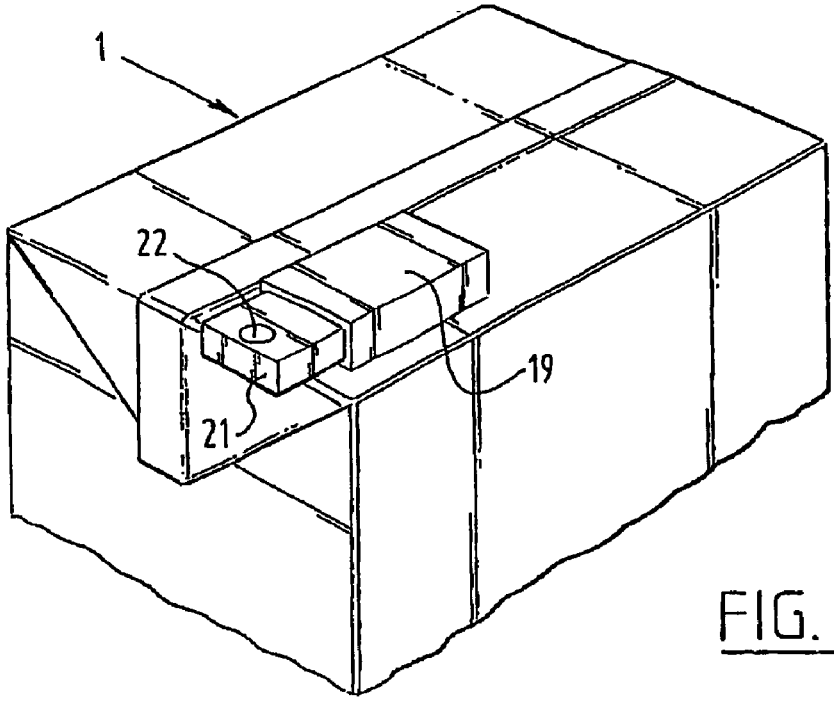
FIG. 7 shows a perspective view of a fifth embodiment of the invention.
Figure 8A:
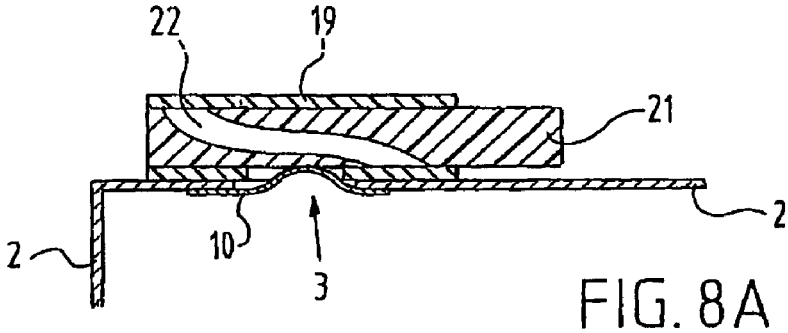
FIG. 8A shows a cross-section of the embodiment of FIG. 7 in the closed position.
Figure 8B:
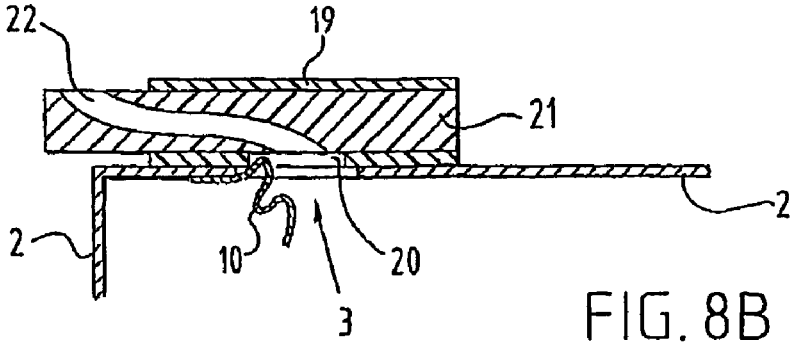
FIG. 8B is a cross-sectional view corresponding is with FIG. 8A in the opened position.

Finally, FIGS. 7, 8A and 8B show a slightly different configuration; use is made here of a sleeve 19 manufactured from rigid material and placed on cardboard laminate 2 by means of a sealing adhesive layer. Sleeve 19 is provided on its underside with an opening 20 which coincides with opening 3 in container 1.

A slide element 21 is arranged slidably inside sleeve 19. Arranged in slide element 21 is a channel 22 through which the fluid can be poured.

The slide element is displaceable between a closed position as shown in FIG. 8A and an opened position as shown in FIG. 8B. In the closed position both ends of channel 22 are closed by sleeve 19, and in the opened position the bottom end of the channel connects onto the opening 3 while the other end leads to the outside. Another configuration of the channel can of course be chosen. It is also attractive if the sealing foil 10 is connected on one end to the slide element; when the slide element is opened the sealing foil is automatically broken.

Although the pouring spout is not shown in the drawings, it can be placed connecting onto the closure of this embodiment.

The invention claimed is:

1. Container for a fluid, comprising a pouring opening and a pouring element connected to the pouring opening, wherein the pouring element comprises a pouring spout manufactured from a flexible material which is connected by means of a sealing connection to the container, the pouring element is provided with both a once-only breakable closure and with a resealable closure, the breakable closure comprising a sealing foil arranged in the opening, and characterized in that the sealing foil is fixedly connected to a pull element extending through the pouring spout to a position outside the spout, and that the connection between the pull element and the sealing foil is stronger than the connection between the sealing foil and the inner side of the container.

2. Container as claimed in claim 1, characterized in that the pull element is connected to the side of the sealing foil opposite to a pulling direction.

3. Container as claimed in claim 1, characterized in that the pouring spout is manufactured from the same material as the pull element, and that a combination of spout and pull element is manufactured by folding a piece of material of appropriate dimensions into an S-shape.

4. Container as claimed in claim 3, characterized in that the pull element is connected to the pouring spout by weakened bridges and parts of the pouring spout lying onto one another are mutually connected by sealing.

5. Container as claimed in claim 1, characterized in that the sealing foil is formed integrally with the pull element.

6. Container as claimed in claim 5, characterized in that the pull element is formed by a part of the pouring spout.

7. Container as claimed in claim 6, characterized in that the pouring spout is provided with a fold, of which a part extending in the interior of the spout is connected to the sealing foil, and a part of the fold extending outside the spout can be grasped to pull loose the sealing foil while preserving the integrity of the pouring spout.

8. Container as claimed in claim 2, characterized in that the pouring spout is manufactured from the same material as the pull element, and that the combination of spout and pull element is manufactured by folding a piece of material of the appropriate dimensions into an S-shape.

9. Container for a fluid, comprising a pouring opening and a pouring element connecting onto the pouring opening, wherein the pouring element comprises a pouring spout manufactured from a flexible material which is connected by means of a sealing connection to the container, the pouring element is provided with both a once-only breakable closure and with a resealable closure, the breakable closure comprising a sealing foil arranged in the opening, characterized in that the resealable closure is arranged on the distal end of the pouring spout, and in that the resealable closure comprises adhesive strips arranged on the inside of the spout, placed opposite each other and capable of repelling a content of the container.

10. Container for a fluid, comprising a pouring opening and a pouring element connecting onto the pouring opening, wherein the pouring element comprises a pouring spout manufactured from a flexible material which is connected by means of a sealing connection to the container, the pouring element is provided with both a once-only breakable closure and with a resealable closure, the breakable closure comprising a sealing foil arranged in the opening, characterized in that the resealable closure is arranged on the distal end of the pouring spout, and in that the resealable closure is adapted to be effective when the pouring spout is folded along a fold direction in a folded state, characterized in that the pouring spout is provided with strengthening which is provided with a thinned portion extending in the fold direction.

* * * * *